US010340598B2

(12) United States Patent
Sasaki et al.

(10) Patent No.: US 10,340,598 B2
(45) Date of Patent: Jul. 2, 2019

(54) LOOP ANTENNA ARRAY

(71) Applicant: Nippon Telegraph and Telephone Corporation, Tokyo (JP)

(72) Inventors: Ai-ichiro Sasaki, Atsugi (JP); Akihiko Hirata, Atsugi (JP); Fumiharu Morisawa, Atsugi (JP); Souichi Oka, Atsugi (JP); Osamu Kagami, Atsugi (JP)

(73) Assignee: Nippon Telegraph and Telephone Corporation (JP)

( * ) Notice: Subject to any disclaimer, the term of this patent is extended or adjusted under 35 U.S.C. 154(b) by 0 days.

(21) Appl. No.: 15/764,964

(22) PCT Filed: Aug. 23, 2016

(86) PCT No.: PCT/JP2016/074518
§ 371 (c)(1),
(2) Date: Mar. 30, 2018

(87) PCT Pub. No.: WO2017/126147
PCT Pub. Date: Jul. 27, 2017

(65) Prior Publication Data

US 2018/0287257 A1 Oct. 4, 2018

(30) Foreign Application Priority Data

Jan. 22, 2016 (JP) ..... 2016-010749

(51) Int. Cl.
*H01Q 7/04* (2006.01)
*H01Q 7/00* (2006.01)
(Continued)

(52) U.S. Cl.
CPC ..... *H01Q 7/04* (2013.01); *H01Q 3/26* (2013.01); *H01Q 7/00* (2013.01); *H01Q 21/08* (2013.01); *H01Q 21/24* (2013.01)

(58) Field of Classification Search
CPC ..... H01Q 7/00; H01Q 7/04; H01Q 21/08; H01Q 21/24; H01Q 3/26
See application file for complete search history.

(56) References Cited

U.S. PATENT DOCUMENTS 2,235,163 A * 3/1941 Peterson ..... H01Q 7/00 343/732
4,260,990 A * 4/1981 Lichtblau ..... G08B 13/2471 340/572.5
(Continued)

FOREIGN PATENT DOCUMENTS

CN 1243609 A 2/2000
CN 101356690 A 1/2009
(Continued)

OTHER PUBLICATIONS

International Search Report, PCT Application No. PCT/JP2016/074921, dated Sep. 20, 2016.
(Continued)

*Primary Examiner* — Dameon E Levi
*Assistant Examiner* — Ab Salam Alkassim, Jr.
(74) *Attorney, Agent, or Firm* — Kilpatrick Townsend & Stockton LLP

(57) ABSTRACT

A loop antenna array that can form a linear and clear communication area boundary is provided. The loop antenna array includes two loop antennas. Currents flow through the loop antennas in opposite directions from each other. In other words, viewing in a direction passing through each of the loop antennas, at a timing when a positive voltage is applied to a signal terminal of an alternating-current source, a clockwise current flows through one loop antenna while a counterclockwise current flows through the other loop antenna. Conversely, at a timing when a negative voltage is applied to the signal terminal of the alternating-current
(Continued)

SECOND EMBODIMENT source, a counterclockwise current flows through one loop antenna while a clockwise current flows through the other loop antenna.

5 Claims, 7 Drawing Sheets

(51) Int. Cl.
*H01Q 21/08* (2006.01)
*H01Q 21/24* (2006.01)
*H01Q 3/26* (2006.01)

(56) References Cited

U.S. PATENT DOCUMENTS 4,751,516 A * 6/1988 Lichtblau ..... G08B 13/2474 343/741
4,866,455 A * 9/1989 Lichtblau ..... G08B 13/2474 343/742
5,218,371 A 6/1993 Copeland et al.
5,694,139 A * 12/1997 Saito ..... G06K 7/10316 343/741
5,914,692 A 6/1999 Bowers et al.
6,137,447 A * 10/2000 Saitoh ..... G06K 7/10336 235/492
6,388,628 B1 * 5/2002 Dettloff ..... G06K 7/0008 343/742
6,960,984 B1 * 11/2005 Vicci ..... G06K 7/0008 340/10.1
7,342,548 B2 * 3/2008 Taniguchi ..... H01Q 1/2216 343/742
8,422,973 B2 * 4/2013 Takarada ..... H01Q 7/00 340/572.1
9,276,616 B2 * 3/2016 Story ..... H04B 1/04
9,450,303 B2 * 9/2016 Su ..... H01Q 1/526
9,899,145 B2 * 2/2018 Covic ..... H01F 38/14
10,124,684 B2 * 11/2018 Merkel ..... H02J 7/025
10,177,823 B2 * 1/2019 Sasaki ..... H04B 7/04
2001/0000960 A1 * 5/2001 Dettloff ..... G06K 7/0008 343/748
2002/0027527 A1 * 3/2002 Jiang ..... H01Q 1/38 343/700 MS
2003/0063034 A1 * 4/2003 Taniguchi ..... H01Q 1/22 343/700 MS
2004/0183742 A1 * 9/2004 Goff ..... B82Y 20/00 343/867
2004/0196205 A1 * 10/2004 Shishido ..... G06K 7/10336 343/867
2005/0134519 A1 * 6/2005 Fukano ..... G06K 7/10336 343/867
2006/0176624 A1 * 8/2006 Kuroda ..... H01L 23/48 361/38
2009/0179818 A1 * 7/2009 Rhodes ..... H01Q 3/40 343/867
2010/0001914 A1 * 1/2010 Lavedas ..... H01Q 1/2216 343/742
2012/0146580 A1 * 6/2012 Kitamura ..... H01F 38/14 320/108
2012/0248883 A1 * 10/2012 Konanur ..... H01F 21/12 307/104
2013/0069441 A1 * 3/2013 Verghese ..... G01R 33/10 307/104
2013/0200721 A1 * 8/2013 Kurs ..... H04B 5/0037 307/104
2013/0324041 A1 * 12/2013 Pagani ..... H01L 23/5387 455/41.1
2014/0111019 A1 * 4/2014 Roy ..... G01V 3/081 307/104
2015/0090789 A1 * 4/2015 Kastner ..... H01Q 1/2216 235/439
2015/0091758 A1 * 4/2015 Ikeda ..... H01Q 7/00 342/385
2015/0138034 A1 * 5/2015 Su ..... H01Q 1/526 343/842
2015/0261985 A1 * 9/2015 Ramsch ..... G06K 7/10336 235/439
2016/0079658 A1 * 3/2016 Jung ..... H01Q 1/243 343/702
2017/0373389 A1 * 12/2017 Mandai ..... H01Q 7/00
2018/0205157 A1 * 7/2018 Sasaki ..... H01Q 7/00

FOREIGN PATENT DOCUMENTS

EP 1 128 464 A1 8/2001
EP 1 233 367 A2 8/2002
JP 10-209737 A 8/1998
JP 2004-328722 A 11/2004
JP 2005-102185 A 4/2005
JP 2007-28472 A 2/2007
JP 2007-174570 A 7/2007
JP 2013-125998 A 6/2013
JP 2014-116887 A 6/2014
JP 2014-212383 A 11/2014
JP 2015-508987 A 3/2015

OTHER PUBLICATIONS

Office Action, Japanese Patent Application No. 2016-010749, dated Jul. 19, 2016.
Office Action, Japanese Patent Application No. 2016-250475, dated Nov. 7, 2017.
Decision to Grant, Japanese Patent Application No. 2016-010749, dated Nov. 22, 2016.
Decision to Grant, Japanese Patent Application No. 2016-250475, dated Dec. 18, 2017.
International Preliminary Report on Patentability, PCT Application No. PCT/JP2016/074518, dated Aug. 2, 2016.
International Search Report, PCT Application No. PCT/JP2016/074518, dated Oct. 11, 2016.
Office Action, Chinese Patent Application No. 201680058447.1, dated Sep. 5, 2018.
Office Action, Chinese Patent Application No. 201680058447.1, dated Feb. 12. 2019.
European Supplementary Search Report, European Patent Application No. 16886387.6, dated Mar. 29, 2019.
Jin et al., "Electrically Large Zero-Phase-Shift Line Grid-Array UHF Near-Field RFID Reader Antenna", IEEE Transactions on Antennas and Propagation, IEEE Service Center, Piscataway, NJ, US, vol. 62, No. 4, Apr. 1, 2014, pp. 2201-2208.

* cited by examiner

FIRST EMBODIMENT

SECOND EMBODIMENT

THIRD EMBODIMENT

LOOP ANTENNA ARRAY

This application is a national stage application of PCT/JP2016/074518, which claims priority to Japanese Application No. 2016-010749, both of which are incorporated herein by reference.

TECHNICAL FIELD

The present invention relates to a loop antenna array that can form a linear and clear communication area boundary.

BACKGROUND ART

Recently, the need for radio communications whose communication areas are intentionally limited (limited-area radio) has been increased. For example, an "electric field communication system" disclosed in the following patent document 1 is one means for implementing the limited-area radio.

PRIOR ART DOCUMENT

Patent Document

Patent document 1: Japanese Patent Application Publication No. 2007-174570

SUMMARY OF THE INVENTION

Problem to be Solved by the Invention

In the electric field communication, only terminal devices that exist in an area neighboring an access point device installed in the environment can communicate with the access point device. However, the electric field distribution in the neighborhood of the access point heavily depends on the installation environment, posture of a user, and the like; thus, it has been difficult to achieve a linear and clear communication area boundary by the electric field. Accordingly, there arises a case where a terminal device cannot establish communications even when the terminal device exists in a position that should allow the communication, and also the opposite case may occur; thus, it has been impossible to construct a stable and highly reliable limited-area radio system.

It can be thought that one of the reasons that such a difficulty occurs is that the electric field is used as a communication medium; because the electric field distribution is strongly affected by a conductor and a dielectric existing around.

The present invention has been made in view of the above problems, and an object thereof is to provide a loop antenna array that can form a linear and clear communication area boundary.

Means for Solving the Problem

In order to solve the above problems, a loop antenna array of the present invention includes two loop antennas through which currents flow in opposite directions from each other.

Effect of the Invention

According to the loop antenna array of the present invention, since the loop antenna array includes two loop antennas through which currents flow in opposite directions from each other, a linear and clear communication area boundary can be formed.

MODE FOR CARRYING OUT THE INVENTION

Hereinafter, embodiments of the present invention are described with reference to the drawings.

A loop antenna array of the present invention is a magnetic field antenna. For example, a low frequency (about 10 MHz or below) magnetic field has a feature that interaction thereof with a human body and surrounding environment is significantly lower than an electric field. Thus, it can be thought that using the low frequency magnetic field as a communication medium may be one means for solving the problems. In addition, if "sharp magnetic field distribution" that allows magnetic field strength to be rapidly attenuated at a communication area boundary can be made, it is possible to construct a highly reliable limited-area radio system.

Figure 8:
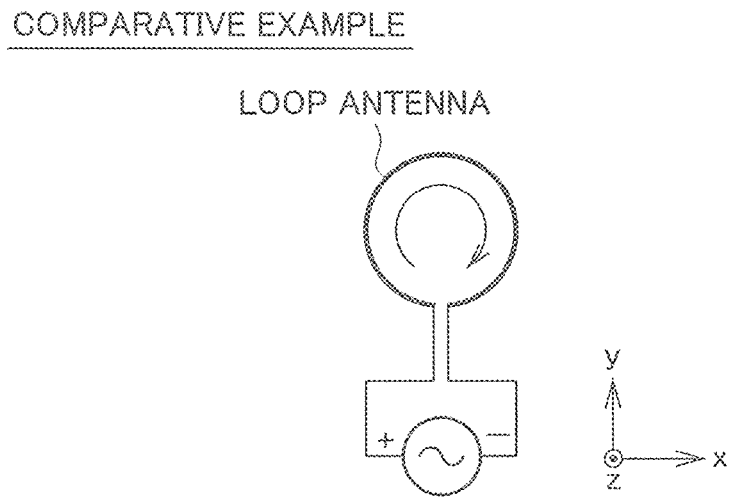
FIG. 8 is a diagram illustrating a loop antenna that is a comparative example of the loop antenna arrays of the present embodiments.
Figure 9:
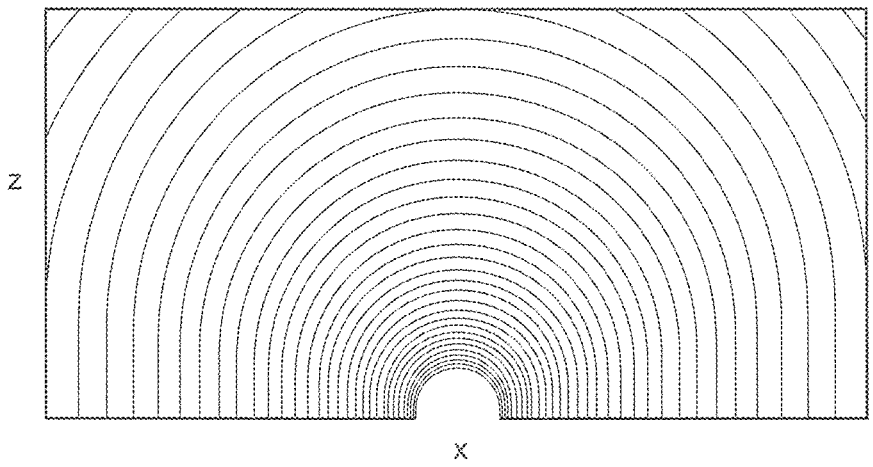
FIG. 9 is a diagram illustrating a magnetic field area formed by the loop antenna illustrated in FIG. 8.

However, in a loop antenna having one loop (FIG. 8), which is generally used for magnetic field area formation, an attenuation rate of the magnetic field is 60 dB/dec, and additionally the shape of the magnetic field area to be formed is curved as illustrated in FIG. 9. Thus, forming a linear and clear communication area boundary is difficult.

First Embodiment

Figure 1:
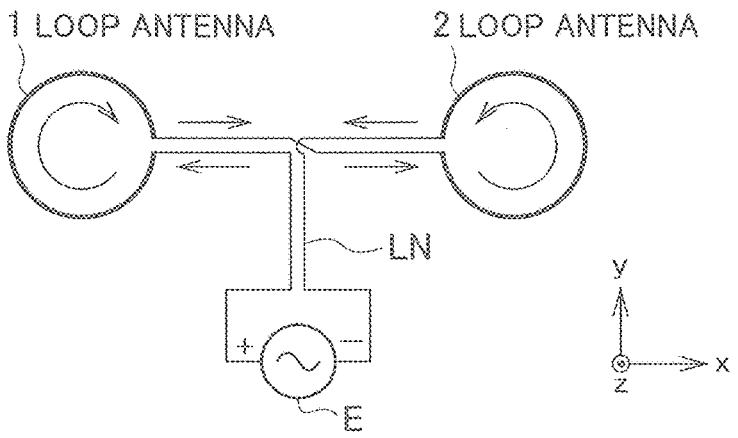
FIG. 1 is a diagram illustrating an example of a loop antenna array of a first embodiment.
Figure 2:
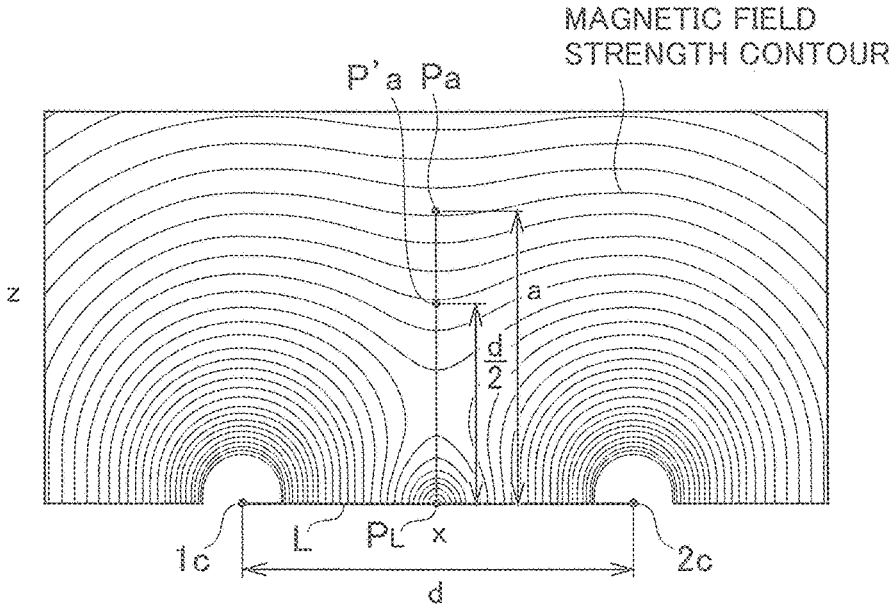
FIG. 2 is a diagram illustrating a magnetic field area formed by the loop antenna array in FIG. 1.

FIG. 1 is a diagram illustrating an example of a loop antenna array of a first embodiment. FIG. 2 is a diagram illustrating a magnetic field area formed by the loop antenna array in FIG. 1.

As illustrated in FIG. 1, the loop antenna array includes two loop antennas 1 and 2. Each of the loop antennas 1 and 2 is a conductor formed in a loop form and that is, for example, formed on an unillustrated board (on the same plane). Each of the loop antennas 1 and 2 has, for example, the same shape (circle) and the same area size surrounded by the loop antenna, and the number of loops is one.

The loop antennas 1 and 2 are, for example, formed of a continuous conductor wire LN. The + terminal, which is one end of the conductor wire LN, is connected to a signal terminal of an alternating-current source E while the – terminal, which is the other end of the conductor wire LN, is connected to a GND terminal of the alternating-current source E.

Currents flow through the loop antennas 1 and 2 in opposite directions from each other. In other words, viewing in a direction passing through each of the loop antennas 1 and 2 (z direction), at a timing when a positive voltage is applied to the signal terminal of the alternating-current source E, a clockwise current flows through the loop antenna 1 while a counterclockwise current flows through the loop antenna 2. Conversely, at a timing when a negative voltage is applied to the signal terminal of the alternating-current source E, a counterclockwise current flows through the loop antenna 1 while a clockwise current flows through the loop antenna 2.

Note that the currents in opposite directions from each other may flow by providing the + terminal and the − terminal on each of the loop antennas 1 and 2, that is, no continuous conductor wire is used for the formation, to connect the + terminal of the loop antenna 1 and the − terminal of the loop antenna 2 to the signal terminal of the alternating-current source E, and to connect the − terminal of the loop antenna 1 and the + terminal of the loop antenna 2 to the GND terminal of the alternating-current source E.

Alternatively, the currents in opposite directions from each other may flow by providing the + terminal and the − terminal on each of the loop antennas 1 and 2, and by providing two alternating-current sources to connect the + terminal and the − terminal of the loop antenna 1 to a signal terminal and a GND terminal of one alternating-current source respectively, and to connect the + terminal and the − terminal of the loop antenna 2 to a signal terminal and a GND terminal of the other alternating-current source respectively. In this case, when a positive voltage is applied to the signal terminal of one alternating-current source, it is only necessary to make synchronization such that a negative voltage is applied to the signal terminal of the other alternating-current source.

As illustrated in FIG. 2, in the loop antenna array including the two loop antennas, the communication area boundary can be made flatter than the case of a single loop antenna (FIG. 9).

In respect of making the communication area boundary flat, when a distance from a center point PL of an intercentral line segment L, which connects a center 1*c* of the loop antenna 1 and a center 2*c* of the loop antenna 2, to the communication area boundary having a distance in the direction passing through the loop antenna (z direction) is represented as a (the minimum distance from the center point PL to the communication area boundary), it is preferable that $(d/2)<a$ is made. In other words, it is desirable to set a distance between antennas to satisfy $d<2a$.

As illustrated in FIG. 2, a magnetic field strength contour through a point Pa' having a predetermined distance d/2 (<a) in the z direction from the center point PL does not intersect with an intercentral straight line segment L. Thus, when $d<2a$ is made, a condition that the magnetic field strength contour through a point Pa, which is farther from the center point PL than the point Pa', does not intersect with the intercentral straight line L can be surely satisfied.

The magnetic field strength contour through the point Pa has a part substantially parallel to the intercentral straight line segment L. In other words, this parallel part of the magnetic field strength contour can be used as the linear and clear communication area boundary.

Generally, amplitude of a magnetic field generated in the distance by the loop antenna is proportional to the size of a magnetic dipole moment vector m. m is obtained by the following equation.

$$m=N\cdot I\cdot S$$

N is the number of loops of the loop antenna, I is a value of the current flowing through the loop antenna, S is the area size surrounded by the loop antenna, and a direction of m (vector) is a direction of a right screw with respect to the direction of the current rotation.

In the first embodiment, since the currents flow in opposite directions, when the shape, the area size, and the number of loops of each of the loop antennas 1 and 2 are the same, the sum of m in light of the orientation becomes zero, for example.

Figure 7:
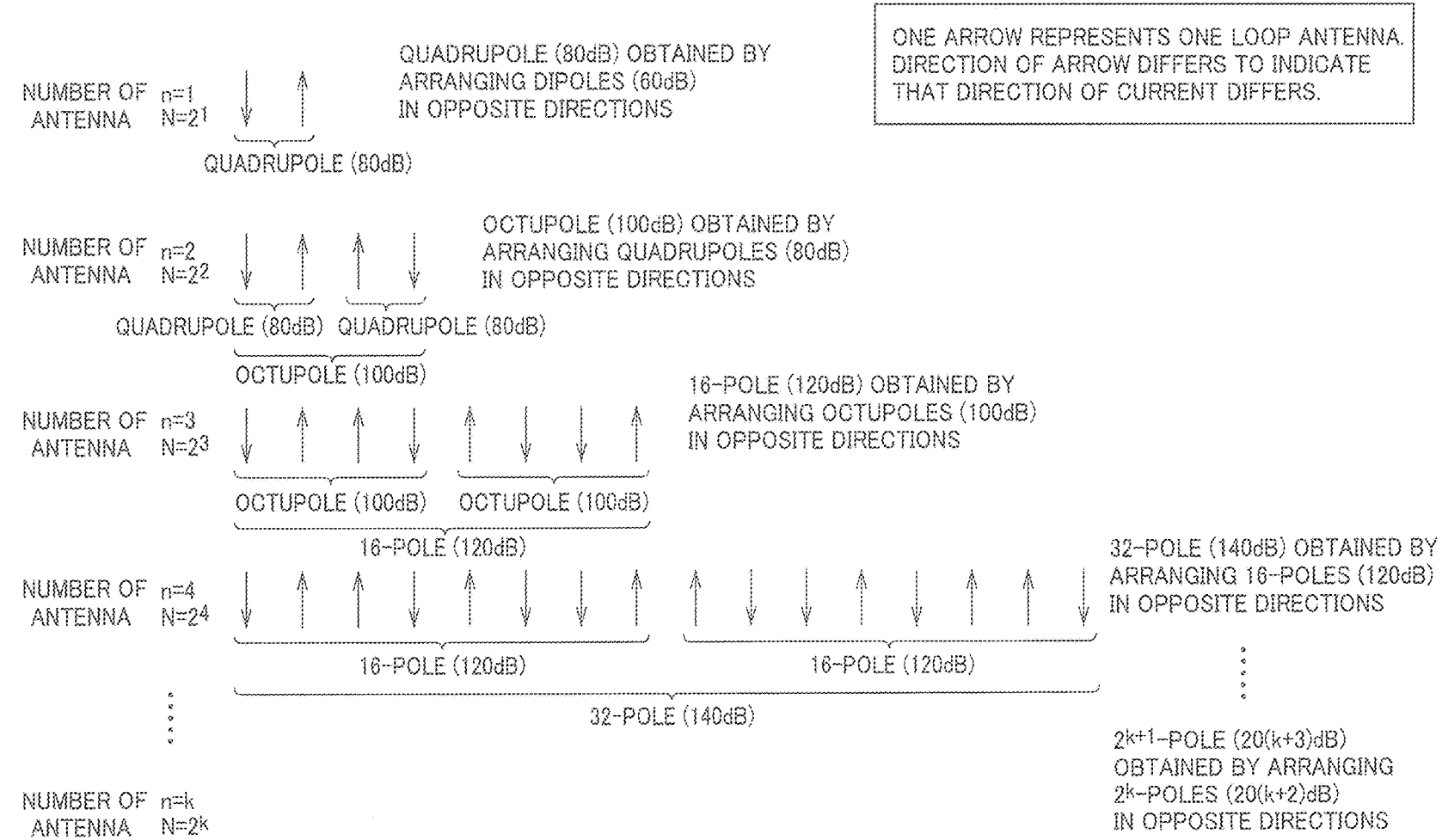
FIG. 7 is an explanatory diagram illustrating an effect of the loop antenna array of each embodiment.

In other words, as illustrated in FIG. 7, the loop antenna array of the first embodiment can be seen as a quadrupole obtained by arranging the loop antennas having one loop (60 dB/dec of attenuation rate) in opposite directions, and the attenuation rate of this magnetic field is 80 dB/dec.

In other words, according to the first embodiment, a sharper magnetic field area (communication area) than that of the loop antenna having one loop can be formed.

Note that a shape of the magnetic field area does not depend on the shape of the loop antenna; thus, the shape of the magnetic field may be other than a circle, such as a square, a rectangle, an oval, a sector, a triangle, a semicircle, a spiral, and a helix. However, the shape is not limited thereto. The shape is only necessary to be a shape that forms the magnetic dipole moment vector when the current flows.

In addition, the number of loops is not limited to one. Moreover, N×S (the number of loops×the area size) of each of the loop antenna 1 and 2 may be made equal while the shape may be different.

Second Embodiment

Figure 3:
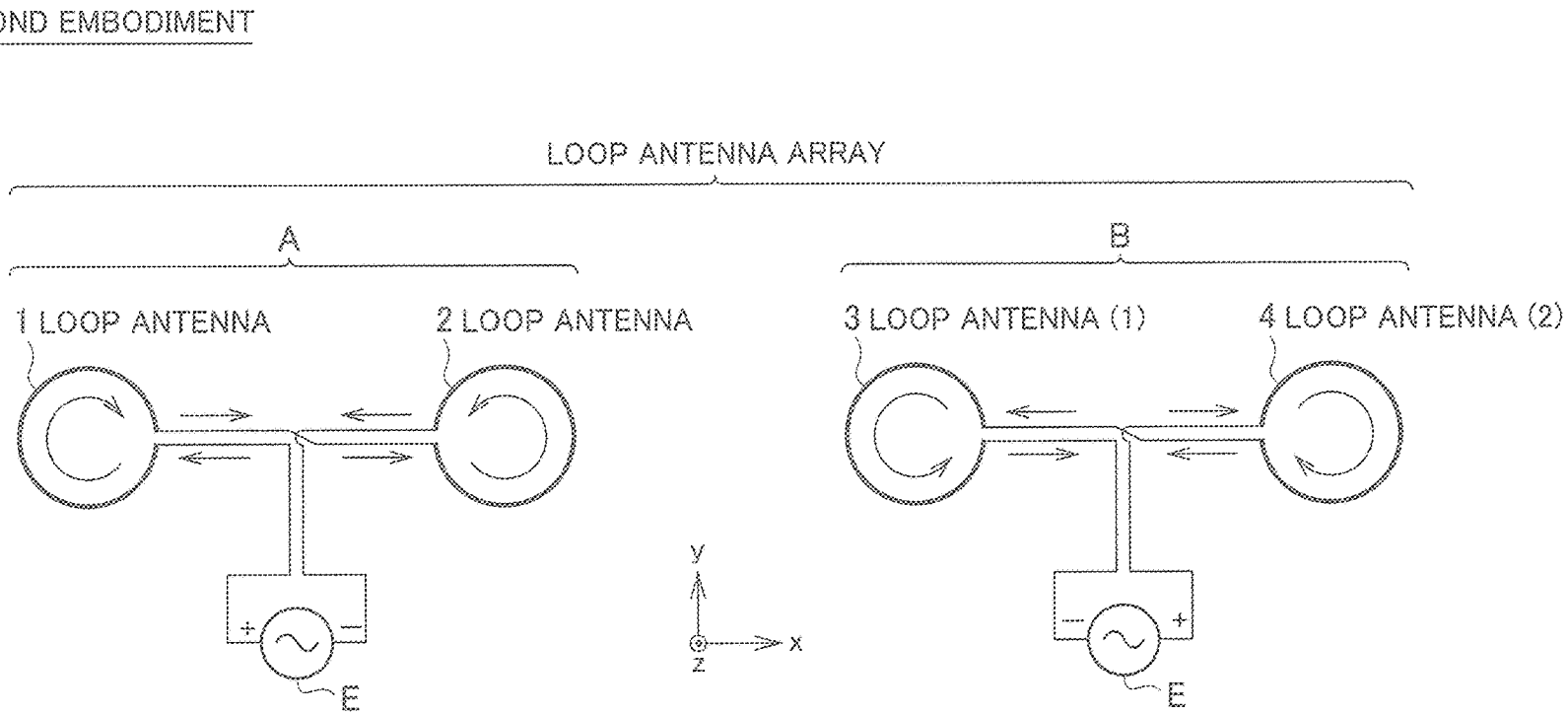
FIG. 3 is a diagram illustrating an example of a loop antenna array of a second embodiment.
Figure 4:
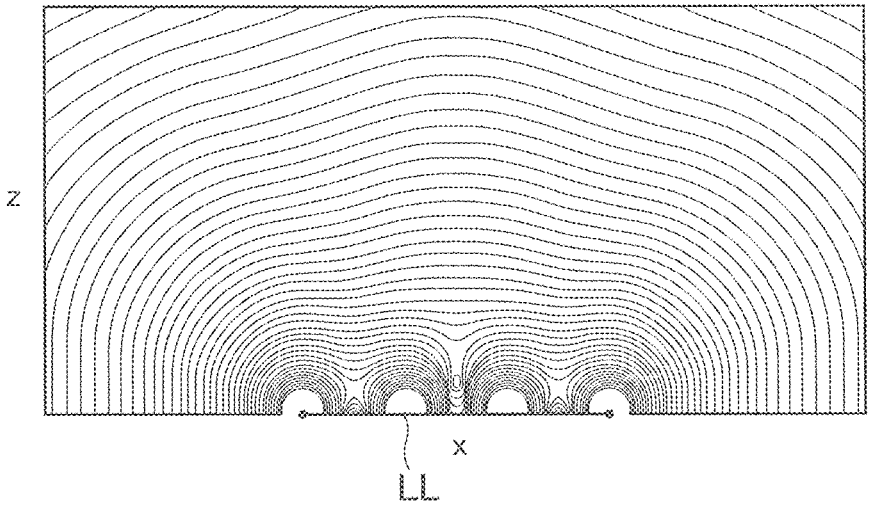
FIG. 4 is a diagram illustrating a magnetic field area formed by the loop antenna array in FIG. 3.

FIG. 3 is a diagram illustrating an example of a loop antenna array of a second embodiment. FIG. 4 is a diagram illustrating a magnetic field area formed by the loop antenna array in FIG. 3.

The loop antenna array of the second embodiment includes multiple (two) loop antenna arrays of the first embodiment (FIG. 1). In other words, two loop antennas 1 and two loop antennas 2 are included. All loop antennas are arranged on the same plane. For convenience sake, one of the loop antennas 1 is called a loop antenna 3 while one of the loop antennas 2 is called a loop antenna 4.

In the loop antenna array, the total number of the loop antenna is 2 to the n-th power (n=2)=4.

In addition, all centers of the loop antennas 1 to 4 are arranged on the same straight line segment LL.

Moreover, when a group of the 2 to the (n−1)-th power (=two) loop antennas is a unit loop antenna array, the loop antennas 1 and 2 make one unit loop antenna array A while the loop antennas 3 and 4 make another unit loop antenna array B.

The direction of the current flowing through the loop antenna 1 positioned at one end side (e.g., the left side of the drawing) of the same straight line segment LL in one unit loop antenna array A and the direction of the current flowing through the loop antenna 3 positioned at the one end side (e.g., the left side of the drawing) in the other unit loop antenna array B are opposite from each other.

Since the loop antenna array of the second embodiment includes the multiple loop antenna arrays of the first embodiment, and since d<2a is preferably made in each loop antenna array (see FIG. 2), the magnetic field strength contour having a distance a from the same straight line segment LL has a part substantially parallel to the same straight line segment LL. In other words, this parallel part of the magnetic field strength contour can be used as the linear and clear communication area boundary.

Since the orientation of the current is just like the above in the second embodiment, when the shape, the area size, and the number of loops of each of the loop antennas 1 to 4 are the same, the sum of m in light of the orientation becomes zero, for example.

In other words, as illustrated in FIG. 7, the loop antenna array of the second embodiment can be seen as an octupole obtained by arranging the quadrupoles in opposite directions, and the attenuation rate of this magnetic field is 100 dB/dec.

In other words, according to the second embodiment, a shaper magnetic field area (communication area) than that of the first embodiment can be formed.

Also, in the second embodiment, the shape of the loop antenna is not limited to a circle. The shape may be different in each loop antenna or in each unit loop antenna array. The number of loops is not limited to one. The loop antennas 1 and 2 may not be formed of the continuous conductor wire. In addition, the loop antennas 2 and 3 may be formed of the continuous conductor wire. In other words, even indifferent loop antenna arrays, a pair of the adjacent loop antennas may be formed of the continuous conductor wire.

Figure 5:
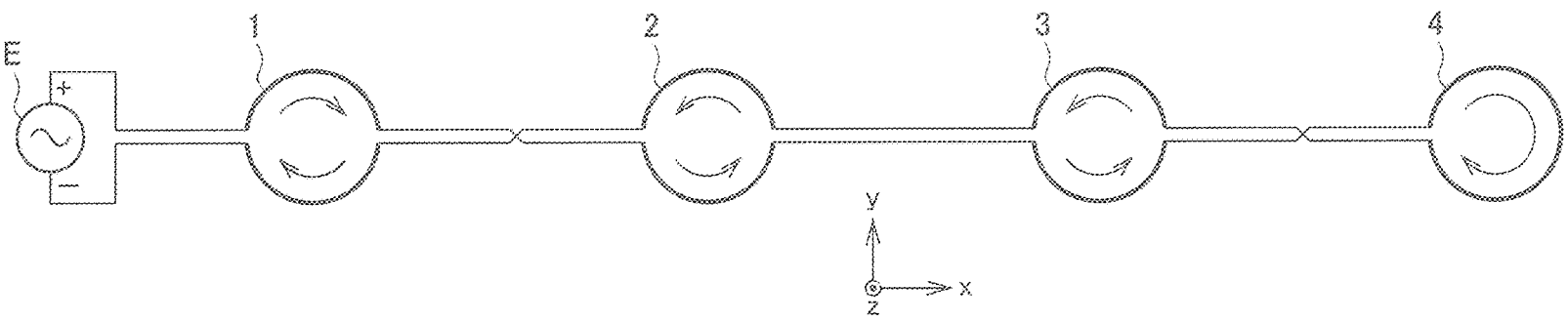
FIG. 5 is a diagram illustrating an example of a loop antenna array of a modification of the second embodiment.

In addition, as illustrated in FIG. 5, the loop antennas 1 to 4 may be formed of the continuous conductor wire.

Third Embodiment

Figure 6:
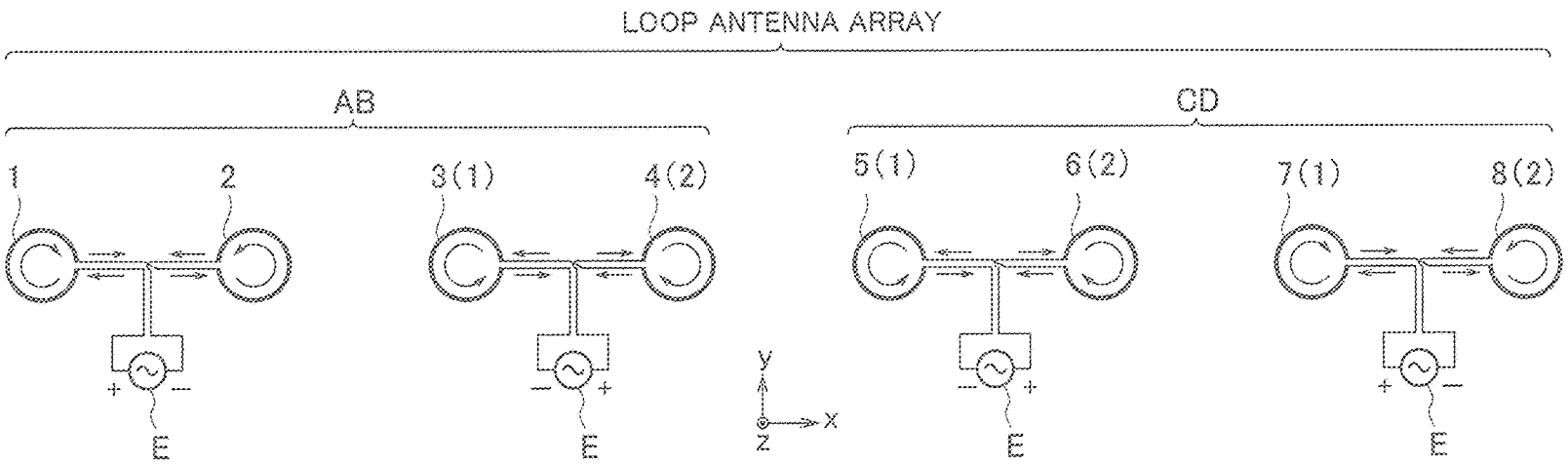
FIG. 6 is a diagram illustrating an example of a loop antenna array of a third embodiment.

FIG. 6 is a diagram illustrating an example of a loop antenna array of a third embodiment.

The loop antenna array of the third embodiment includes multiple (four) loop antenna arrays of the first embodiment (FIG. 1). In other words, four loop antennas 1 and four loop antennas 2 are included. All loop antennas are arranged on the same plane. For convenience sake, the loop antennas 1 are called loop antennas 3, 5, and 7 except one of the loop antennas 1 while the loop antennas 2 are called loop antennas 4, 6, and 8 except one of the loop antennas 2.

In the loop antenna array, the total number of the loop antenna is 2 to the n-th power (n=3)=8.

In addition, all centers of the loop antennas 1 to 4 are arranged on the same straight line segment (not illustrated).

Moreover, when a group of the 2 to the (n−1)-th power (=four) loop antennas is a unit loop antenna array, the loop antennas 1 to 4 make one unit loop antenna array AB while the loop antennas 5 to 8 make another unit loop antenna array CD.

The direction of the current flowing through the loop antenna 1 positioned at one end side (e.g., the left side of the drawing) of the same straight line segment LL in one unit loop antenna array AB and the direction of the current flowing through the loop antenna 5 positioned at the one end side (e.g., the left side of the drawing) in the other unit loop antenna array CD are opposite from each other.

Since the loop antenna array of the third embodiment includes the multiple loop antenna arrays of the first embodiment, and since d/2<a (d<2a) is preferably made in each loop antenna array (see FIG. 2), the magnetic field strength contour having a distance a from the same straight line segment through the center of each loop antenna has a part substantially parallel to the same straight line segment. In other words, this parallel part of the magnetic field strength contour can be used as the linear and clear communication area boundary.

Since the orientation of the current is just like the above in the third embodiment, when the shape, the area size, and the number of loops of each of the loop antennas 1 to 8 are the same, the sum of m in light of the orientation becomes zero, for example.

In other words, as illustrated in FIG. 7, the loop antenna array of the third embodiment can be seen as a 16-pole obtained by arranging the octupoles in opposite directions, and the attenuation rate of this magnetic field is 120 dB/dec.

In other words, according to the third embodiment, a shaper magnetic field area (communication area) than that of the second embodiment can be formed.

Also, in the third embodiment, the shape of the loop antenna is not limited to a circle. The shape may be different in each loop antenna or in each unit loop antenna array. The number of loops is not limited to one. In addition, anyone or more pairs of a pair of the loop antennas 2 and 3, a pair of the loop antennas 4 and 5, and a pair of the loop antennas 6 and 7 may be formed of the continuous conductor wire. In other words, even in different loop antenna arrays, a pair of the adjacent loop antennas may be formed of the continuous conductor wire. Moreover, the loop antennas 1 to 8 may be formed of the continuous conductor wire.

In addition, as illustrated in FIG. 7, n (=k) may be 4 or greater. When k is set as 4 or greater and the loop antennas are aligned, a 2 To the (k+1)-pole is formed, and the attenuation rate of 20 (k+3) dB/dec can be obtained. In other words, as n (=k) is greater, a sharper magnetic field area (communication area) can be formed.

EXPLANATION OF THE REFERENCE NUMERALS

1 to 8 loop antenna
A, B, AB, CD unit loop antenna array

The invention claimed is:

1. A plurality of loop antenna arrays, comprising:

a plurality of loop antennas, wherein the number of the plurality of loop antennas is 2 to the n-th power (n is an integer of 2 or more) and a group of 2 to the (n−1)-th power of the plurality of loop antennas is a unit loop antenna array;

centers of the plurality of loop antennas are arranged on a same straight line segment;

a direction of a current flowing through a loop antenna positioned at one end side of the same straight line segment in one of the unit loop antenna arrays and a direction of a current flowing through a loop antenna positioned at the one end side in another of the unit loop antenna arrays are opposite from each other;

the plurality of loop antennas comprise two loop antennas through which currents flow in opposite directions from each other, the two loop antennas arranged so that a straight line distance between centers of the two loop antennas is shorter than twice a distance from a center point between the centers to a communication area boundary, which is a magnetic field strength contour that allows a terminal device to communicate, through a point having a distance in a direction passing through the loop antenna; and the two loop antennas have the same shape while positions of the centers of the two loop antennas are different.

2. The plurality of loop antenna arrays according to claim 1, wherein the two loop antennas are arranged on the same plane.

3. The plurality of loop antenna arrays according to claim 1, wherein a sum of magnetic moments of the two loop antennas is zero.

4. The plurality of loop antenna arrays according to claim 1, wherein the loop antenna array is of any one of a square, a circle, a rectangle, an oval, a sector, a triangle, a semicircle, a spiral, and a helix.

5. The plurality of loop antenna arrays according to claim 1, wherein in a loop antenna array including adjacent two of the plurality of loop antennas, one loop antenna and the other loop antenna are formed of a continuous conductor wire.

* * * * *